United States Patent [19]

Ranz et al.

[11] Patent Number: 4,635,396

[45] Date of Patent: Jan. 13, 1987

[54] BUS WINDOW RELEASE MECHANISM

[75] Inventors: John C. Ranz, Brewerton; David T. Ahlgren, Syracuse, both of N.Y.

[73] Assignee: O. M. Edwards Company, Inc., Syracuse, N.Y.

[21] Appl. No.: 856,651

[22] Filed: Apr. 28, 1986

[51] Int. Cl.[4] ..... E05B 65/10

[52] U.S. Cl. ..... 49/141; 49/394; 292/87; 292/DIG. 33

[58] Field of Search ..... 49/141, 394; 292/87, 292/DIG. 33

[56] References Cited

U.S. PATENT DOCUMENTS

| | | | |
|---|---|---|---|
| 3,913,265 | 10/1975 | Ehret et al. | 49/141 |
| 3,942,286 | 3/1976 | Ehret et al. | 49/141 |
| 4,186,953 | 2/1980 | O'Connor | 49/141 X |
| 4,313,280 | 2/1982 | Ehret et al. | 49/141 |

*Primary Examiner*—Kenneth Downey
*Attorney, Agent, or Firm*—Bruns and Wall

[57] ABSTRACT

A release mechanism for a vehicle escape sash employs a latch mechanism of novel construction, with parts configured as keeper, hinged latch member, and sash bar. The keeper has a keeper flange that projects upward from a web of the keeper, and has a generally cylindrical undercut recess at its juncture with the web. The recess defines a latch seat. The latch member has a sash plate mounted to the window sash rail and a latch plate hingedly connected to the sash plate. A depending flange on the latch plate has a cylindrical head at its free end that fits into the keeper recess and makes continuous rolling contact therewith when the keeper and latch member are latched together. The sash bar is mounted onto the latch plate and extends inwardly over the latch member, the keeper, and the sash subframe. The sash bar both serves as a cover and as a release handle.

6 Claims, 4 Drawing Figures

BUS WINDOW RELEASE MECHANISM

BACKGROUND OF THE INVENTION

This invention relates to escape sash release mechanisms, especially in connection with a large vehicle window which serves as an emergency escape, and more particularly side windows in buses, trains, or the like.

It is common practice for large vehicles used in passenger service to provide the side windows as emergency escapes. With such an arrangement, at least one window sash on each side of the vehicle is an escape sash which is hinged or otherwise pivotally mounted at one of its edges so it can be swung out of the window opening to provide an emergency exit. The unhinged or free side of the sash is maintained closed and weathertight by a relatively uncomplicated latch mechanism. In modern buses and passenger trains the windows are rather elongated, and extend alongside several rows of seats. In that case, instead of a single latch mechanism, several latches are employed along the sash to hold the window closed and weathertight but without buckling. A sash bar generally extends along the inside of the sash on the latch side of the window and is connected to each of the latch mechanism releases, so that in the event of an emergency a passenger can, by simply raising the sash bar, unlatch all the latch mechanisms to open the window.

A number of escape sash release mechanisms have been proposed, for example as discussed in U.S. Pat. Nos. 2,830,843; 3,942,286; 3,431,677; 2,015,448; 3,913,265; and 4,313,280.

The latch arrangement of U.S. Pat. No. 4,313,280 has a keeper bar mounted on a fixed part of the sash and a latch and release bar hinged to the swingable part of the sash frame. There, the keeper bar is formed with a keeper flange that is an elongated bead of cylindrical configuration that snap fits into a similarly contoured socket formed in the sash release bar. Generally, both the keeper and the sash release bar are of extruded aluminum. The keeper contacts a flange of the sash bar, but not the hinge member, which is affixed to the sash. This arrangement tends to loosen over time due to wear, and noticeable rattling, with some air leakage, often occurs.

OBJECTS AND SUMMARY OF THE INVENTION

Accordingly, it is an object of this invention to provide an escape sash release mechanism which overcomes the drawbacks of the prior art.

It is another object of this invention to provide an escape sash release mechanism which is simple and reliable, and which will continue to maintain the vehicle window in a securely closed and weather-tight condition even after extended use.

It is a more particular object of this invention to provide an escape sash release mechanism that avoids loosening or rattling problems.

In accordance with an aspect of this invention, a vehicle escape sash release mechanism forms part of the sash for an elongated vehicle window that fits in an opening in a body panel of the vehicle. The window sash is swingably mounted at the top of the window opening. A sash subframe is fixedly mounted on a lower edge of the body panel opening. A sash rail frames the lower edge of the window and bears a resilient sealing gasket that sealably contacts the sash subframe when the window is latched closed. A latch assembly releasably holds the sash rail in place with the resilient sealing gasket compressed against the sash subframe. To hold the escape sash securely but releasably closed, the latch mechanism is of a novel and improved construction, with parts configured as a keeper, a hinged latch member and a sash bar.

The keeper is formed as a keeper bar having a web secured to the sash subframe and a keeper flange that projects upwards from the web. The keeper flange has a rounded head and a generally cylindrical undercut recess at its juncture with the web. This recess defines a latch seat. Preferably, the keeper is extruded of aluminum.

The latch member has a sash plate mounted to the sash rail and extending laterally inwards, i.e., towards the passenger side, of the rail. A latch plate is hingedly connected to the sash plate for flexing up and down, and extending inwards of the sash plate. The latch plate has a flange that extends downwards and the free end of this flange has a cylindrical head that extends generally downward and back towards the sash rail. The round head of the latch plate makes continuous rolling contact with the latch seat of the keeper when the keeper and latch member are latched together, notwithstanding wear and tear from jarring and rough roads that these parts may have to endure. Finally, the sash bar is mounted onto the latch plate and extends inwardly of the latch member over the same, the keeper, and the sash subframe. The sash bar serves as a cover for the keeper and latch member, and also serves as a release handle. When the sash bar is lifted, the round head of the latch member cams over the keeper flange out of the latch seat to release the window for emergency egress.

The same latch bar can be connected to several hinged latch members to engage a corresponding number of keepers.

The above and many other objects, features, and advantages of this invention will be more fully understood and appreciated from the ensuing detailed description of a preferred embodiment, which is to be read in connection with the accompanying drawing.

DETAILED DESCRIPTION OF THE PREFERRED EMBODIMENT

Figure 1:
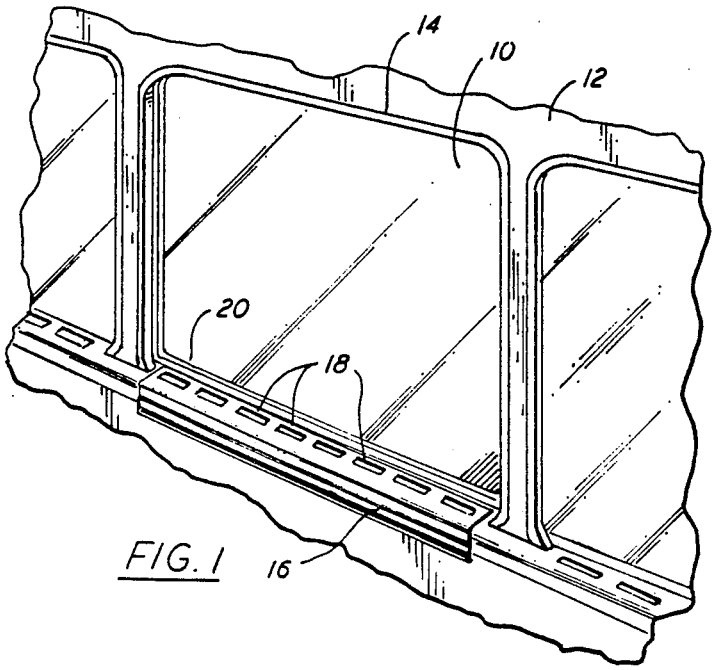
FIG. 1 is a perspective view of a passenger vehicle window having an escape sash and releasable latch mechanism therefore, the perspective being taken from within the vehicle.

With reference to the drawing figures, and initially to FIG. 1, a bus or other passenger vehicle window 10 fits into an opening provided therefore in a side panel 12 of the vehicle, and is framed by a window sash 14. A sash bar 16 extends along the lower edge of the window 10 and serves as an emergency handle for opening the window 10 in the event that emergency egress is required. A number of ventilation openings 18 are provided through the sash bar 16. The sash bar serves also as a cover for the latch mechanism provided therebeneath. This sash bar 16 is hinged to a sash rail 20 which frames the lower edge of the window 10. Hinges are provided at the upper part of the window sash 14. This hinge structure, hidden in FIG. 1, is conventional, and need not be described in detail.

Figure 2:
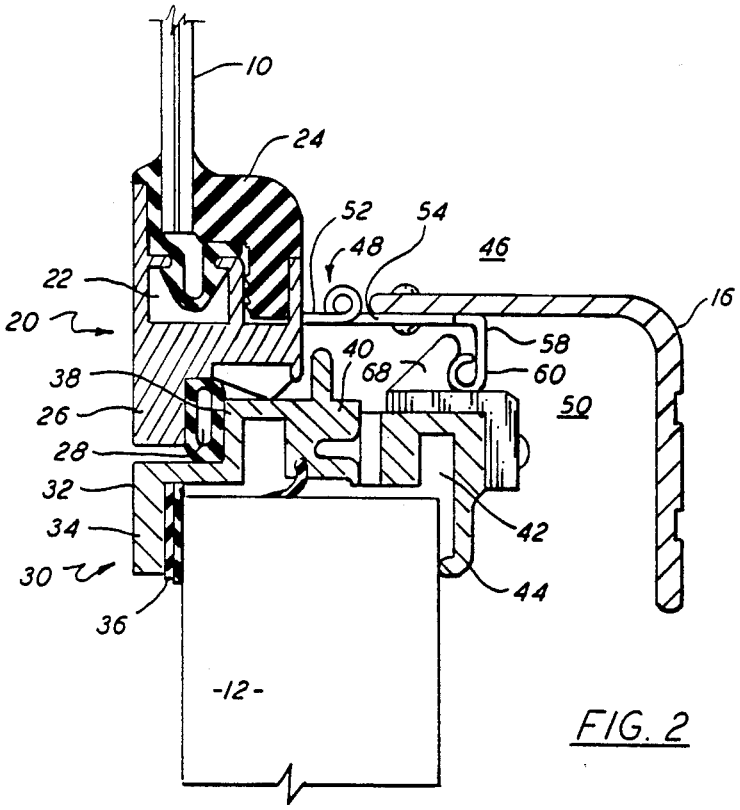
FIG. 2 is a section view of the escape sash latch mechanism of one embodiment of this invention.

The emergency release mechanism of this invention is shown in cross-section in FIG. 2.

The sash rail 20 has a channel 22 for holding the lower edge of the window 10 by means of glazing rubber 24. A depending flange 26 of the sash rail 20 holds a bulb-type sealing gasket 28 formed of a resilient rubber-like material.

A sash subframe 30 mounts onto the lower edge of the opening in the body panel 12. The subframe 30 has an outer clamping member 32 having a clamping jaw 34 which compresses a strip gasket 36 against an outer side of the body panel 12. A recess 38 in the outer clamping member 32 receives the bulb-type sealing gasket 28 and compresses it when the window 10 is closed shut. A connecting flange 40 extends along a top surface of the opening in the body panel 12.

An inner clamping member 42 is fastened to the outer clamping member 32 and has an inner clamping jaw 44 pressing against the inner side of the body panel 12. The clamping members 32 and 42 are fastened together with a screw-type threaded fastener, not shown.

Figure 3:
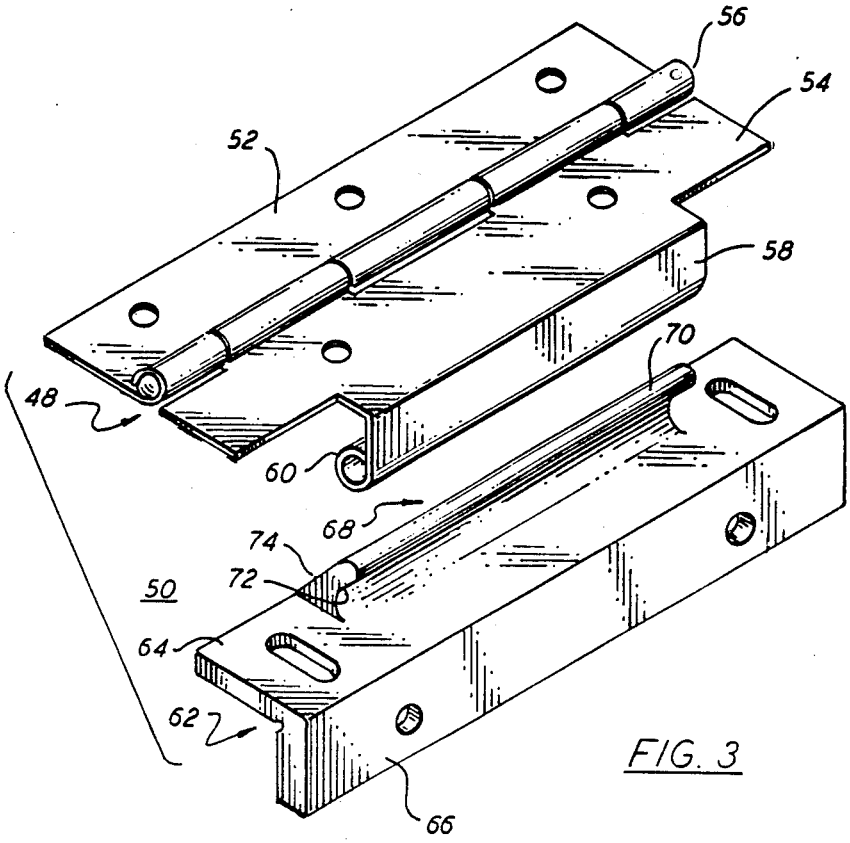
FIG. 3 is a perspective view showing the latch member and the keeper of this embodiment.

A latch assembly 46 for this escape sash comprises a hinged latch member 48 and a keeper 50, shown in more detail in FIG. 3, and the sash bar 16 which is affixed onto the hinged latch member 48 and urges the latter into a snap-fit relationship with the keeper 50.

As shown in FIG. 3, the latch member 48, here preferably formed of stainless steel plate, has a sash plate 52 which is affixed by rivets or bolts to the sash rail 20, and a latch plate 54 disposed towards the passenger side of the sash rail 20 and joined to the sash plate 52 by a hinge 56. With this construction, the latch plate 54 enjoys upward and downward flexing motion with respect to the sash rail 20.

At the passenger side of the latch plate 54 is a depending flange 58 which, at its free end, has a cylindrical bead or head 60. This head 60 is formed by bending the stainless steel plate of the flange 58 in an arc back towards the sash rail and then upwards to form the generally cylindrical shape as shown.

The keeper 50 is formed as a keeper bar 62, preferably of extruded aluminum. This bar 62 is generally an angle member having an upper web 64, disposed atop the inner clamping member 42, and a depending flange 66, disposed at the passenger side of the clamping member 42. The keeper 50 is affixed onto the clamping member 42 by means of bolts or rivets through the apertures shown in FIG. 3.

A keeper flange 68 extends upward and inward along the top surface of the web 64, and has a rounded head 70 and a cylindrical recess 72 beneath the head 70, the recess forming a cylindrical seat for the cylindrical head 60 of the latch member 48. This cylindrical recess 72 is formed at the juncture of the keeper flange 68 with the web 64. At the outer side of the flange 68 is a rising angled striker plate surface 74, which aids in the closing of the latch assembly 46.

The arcuate shape of the head 60 on the latch member 48 and the conforming cylindrical shape of the recess or seat 72 ensures that the head 60 and the recess 72 will maintain continuous rolling contact with each other when the latch assembly 46 is closed. The resilience of the sealing gasket 28, which the sash rail 20 compresses against the recess 38 in the clamping member 32 of the sash subframe 30, biases the head 60 and the recess 72 against one another.

The sash bar 16 is joined to the latch plate 54 of the latch member 48 by means of rivets or other fasteners which pass through the upper edge of the sash bar 16 and through openings provided in the latch plate 54. The sash bar 16 serves as a release handle for the latch assembly 46, with the sash bar 16 being lifted to cam the rounded head 60 of the latch member 48 out of the recess 72 of the keeper 50 to release the window for emergency egress. If it is desired to close the window, the sash bar is drawn in towards the passenger side of the panels 16 to compress the gasket 28 between the sash rail 20 and the recess 38 of the sash subframe 30. Then, the cylindrical head 60 of the latch member 48 cams over the head 70 of the keeper 50, and is seated into the recess 72 of the keeper 50 by pressing down on the sash bar 16.

While a single latch assembly 46 is discussed here, it is understood that in a bus or passenger train window, which extends alongside several rows of passenger seats, two, three or more sets of latch members 48 and associated keepers 50 would be employed. A single sash bar 16 would be affixed to the several latch plates 54 of the latch members 48.

Figure 4:
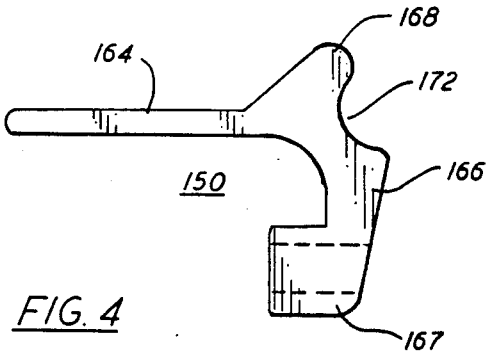
FIG. 4 is a sectional view of a keeper according to an alternative embodiment.

A variant of the keeper 50 of FIG. 3 is shown in section FIG. 4. Here, similar parts are identified with the same reference numbers, but raised by 100. The keeper bar 150 has a web 164 and depending flange 166, which fit into a portion of the sash subframe on the passenger side of the side panel. A keeper flange 168 extends slopingly upward from the web 164 and has a generally cylindrical recess 172 thereon. A lateral projection 167 on the flange 166 fits a corresponding recess in the sash subframe, not shown here.

While the invention has been described with reference to a preferred embodiment, it should be understood that those skilled in the art could carry out the principles of this invention in many other forms without departure from the scope and spirit of this invention, which is defined in the appended claims.

We claim:

1. A release mechanism for a vehicle escape sash provided for an elongated vehicle window in an opening provided in a body panel of the vehicle, said window having a sash swingably mounted at an upper side of said opening, said escape sash having a sash subframe fixedly mounted on a lower edge of said body panel opening, a sash rail framing a lower edge of the window and bearing a resilient sealing member for sealably contacting said sash subframe, and a latch assembly for releasably holding said sash rail in place with said resilient sealing member compressed against said sash subframe, said latch assembly including a keeper having a web secured to said sash subframe and having a keeper flange projecting upwards therefrom, said keeper flange having a rounded head and a generally cylindrical undercut recess defining a latch seat;

a latch member having a sash plate mounted to said sash rail and extending laterally inwards of said sash rail, a latch plate hingedly connected to said sash plate extending laterally inwards of said sash plate and having a depending flange with a generally cylindrical rounded head extending downwardly and generally outwards towards said sash rail, said latch member rounded head making continuous rolling contact with the latch seat of said keeper when the keeper and latch member are latched together; and a sash bar mounted to the latch plate of said latch member and extending inwardly of said latch member over the same and said sash subframe and serving as a release handle, said sash bar being lifted to cam the rounded head of the latch member out of said latch seat and over said keeper flange to release the window for emergency egress.

2. The mechanism of claim 1 wherein said latch member is formed of stainless steel.

3. The mechanism of claim 1 wherein said keeper is formed of extruded aluminum.

4. The mechanism of claim 1 wherein said keeper is in the form of an angle member with a flange depending from said web.

5. The mechanism of claim 1 wherein the latch seat of said keeper is formed at the juncture of said web and said keeper flange such that said latch member head rests against said web when said keeper and said latch member are closed together.

6. The mechanism of claim 1 wherein said rounded head of said latch member is formed by arcuately rolling over a free edge of said depending flange.

* * * * *